US009896290B2

(12) United States Patent
Jacobs et al.

(10) Patent No.: US 9,896,290 B2
(45) Date of Patent: Feb. 20, 2018

(54) SHEET CONVEYING SYSTEM

(71) Applicant: Océ-Technologies B.V., Venlo (NL)

(72) Inventors: Roy H. R. Jacobs, Venlo (NL); Erik E. M. Nolting, Venlo (NL); Mark Rietbergen, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/591,769

(22) Filed: May 10, 2017

(65) Prior Publication Data

US 2017/0240366 A1 Aug. 24, 2017

Related U.S. Application Data

(63) Continuation of application No. PCT/EP2015/075939, filed on Nov. 6, 2015.

(30) Foreign Application Priority Data

Nov. 17, 2014 (EP) ..... 14193513

(51) Int. Cl.
*B65H 29/24* (2006.01)
*B65H 5/22* (2006.01)
(Continued)

(52) U.S. Cl.
CPC ..... *B65H 5/224* (2013.01); *B65H 11/005* (2013.01); *B65H 29/16* (2013.01); *B65H 29/242* (2013.01);
(Continued)

(58) Field of Classification Search
CPC ..... B65H 29/242; B65H 29/16; B65H 5/224; B65H 5/021; B65H 2406/32;
(Continued)

(56) References Cited

U.S. PATENT DOCUMENTS 5,526,105 A 6/1996 Kenin et al.
8,322,712 B2 * 12/2012 Funayanagi ..... B65H 29/242 271/194
(Continued)

FOREIGN PATENT DOCUMENTS

WO WO 2014/175808 A1 10/2014

OTHER PUBLICATIONS

International Search Report, issued in PCT/EP2015/075939 (PCT/ISA/210), dated Feb. 5, 2016.
(Continued)

*Primary Examiner* — Luis A Gonzalez
(74) *Attorney, Agent, or Firm* — Birch, Stewart, Kolasch & Birch, LLP

(57) ABSTRACT

A sheet conveying system includes an upstream conveyor section having an endless first conveyor belt movable in a first conveying direction x and extending in a first lateral direction z, the first conveying direction x and the first lateral direction z defining a first conveying plane xz; and a downstream conveyor section having an endless second conveyor belt that adjoins the first conveyor belt and is movable in a second conveying direction x' and extends in a second lateral direction z', the second conveying direction x' and the second lateral direction z' defining a second conveying plane x'z'. The conveyor sections are adapted to hold the sheets slip-free on the first and second conveyor belts. The second conveyor belt has a shear compliance in the second conveying plane x'z' that is larger than the shear compliance of the first conveyor belt in the first conveying plane xz.

6 Claims, 3 Drawing Sheets

(51) Int. Cl.
*B65H 29/16* (2006.01)
*B65H 11/00* (2006.01)

(52) U.S. Cl.
CPC ..... *B65H 2301/342* (2013.01); *B65H 2301/44735* (2013.01); *B65H 2301/5144* (2013.01); *B65H 2401/141* (2013.01); *B65H 2401/15* (2013.01); *B65H 2404/2691* (2013.01); *B65H 2404/271* (2013.01); *B65H 2404/284* (2013.01); *B65H 2406/32* (2013.01); *B65H 2406/33* (2013.01); *B65H 2511/214* (2013.01); *B65H 2801/06* (2013.01)

(58) Field of Classification Search
CPC ..... B65H 11/005; B65H 2401/141; B65H 2401/242; B65H 2404/281; B65H 2404/284; B65H 2404/271
See application file for complete search history.

(56) References Cited

U.S. PATENT DOCUMENTS

| | | | | |
|---|---|---|---|---|
| 8,500,120 | B2 * | 8/2013 | Mandel | B65H 7/20 271/265.02 |
| 9,707,778 | B2 * | 7/2017 | Jacobs | B41J 11/007 |
| 2014/0001014 | A1 | 1/2014 | Shoji et al. | |
| 2015/0062273 | A1 * | 3/2015 | Ando | B41J 11/0045 347/104 |

OTHER PUBLICATIONS

Written Opinion of the International Searching Authority, issued in PCT/EP2015/075939 (PCT/ISA/237), dated Feb. 5, 2016.

* cited by examiner

SHEET CONVEYING SYSTEM

CROSS REFERENCE TO RELATED APPLICATIONS

This application is a Continuation of PCT International Application No. PCT/EP2015/075939, filed on Nov. 6, 2015, which claims priority under 35 U.S.C. 119(a) to patent application Ser. No. 14/193,513.0, filed in Europe on Nov. 17, 2014, all of which are hereby expressly incorporated by reference into the present application.

The invention relates to a sheet conveying system comprising an upstream conveyor section having an endless first conveyor belt movable in a first conveying direction x and extending in a first lateral direction z, said first conveying direction x and said first lateral direction z defining a first conveying plane xz; and a downstream conveyor section having an endless second conveyor belt that adjoins the first conveyor belt and is movable in a second conveying direction x' and extends in a second lateral direction z', said second conveying direction x' and said second lateral direction z' defining a second conveying plane x'z'.

U.S. Pat. No. 5,526,105 A describes an example of a sheet conveying system of this type, wherein the first and second conveying planes form a certain angle with one another.

Sheet conveying systems are used for example in printers or copiers for conveying the media sheets through the various processing stages such as a printing stage, a fuse stage, a temperature control stage and the like.

In general, it is desired that the conveying sections are aligned with one another, so that the first and second conveying directions are parallel to one another, or, more precisely, the projection of the second conveying direction x' onto the first conveying plane xz is parallel to the first conveying direction x. In practice, however, manufacturing tolerances will always lead to certain alignment errors.

As long as the sheets are allowed to slip relative to the conveyor belts, the alignment errors will be compensated for by a corresponding slip of the sheets. In certain applications, however, it is desired that the sheets are held so firmly on the conveyor belt that they are not allowed to slip. This can be achieved for example by using perforated conveyor belts and disposing suction boxes below the conveyor belt, so that the sheets will be firmly attracted against the belt by vacuum action.

In a high quality printer, a precise alignment of the sheets on the conveyor belts is required, especially in the printing station. Even a minor elastic expansion of the conveyor belt or a minor shear deformation could lead to positioning and alignment errors of the sheets that would degrade the print quality. Therefore, it is preferred to use "stiff" conveyor belts that have a very high elastic expansion modulus and also a high shear modulus, e.g. conveyor belts that are formed by metal films.

A high position accuracy is required in particular in the printing station of a printer, whereas positioning errors may be less critical in other conveying sections where the sheets are passed for example through a cooling station for cooling down the sheets that have been heated in the printing station or the fuse station. Nevertheless, given that the sheets are sometimes re-circulated through the printing station a second time, e.g. in duplex printing, it is desirable to have a high positional accuracy and, consequently, stiff conveyors in the entire conveying system.

In a cooling station, for example, it is convenient to use drum-type conveyors wherein the sheets are sucked against the peripheral surface of a rotating drum that has a relatively large diameter and serves as a heat sink for removing heat from the sheets. In that case, the conveyor is formed by a rigid body that will of course behave very stiff.

When the conveyors in two adjoining conveyor sections have no or very little shear compliance, even a minor misalignment between the conveying directions may cause problems such as sheets being ripped or wrinkled.

It is an object of the invention to provide a sheet conveying system that permits a sheet positioning accuracy as high as possible while avoiding the risk of damage to the sheets.

In order to achieve this object, according to the invention, the sheet conveying system is characterized in that the second conveyor belt has a shear compliance in the second conveying plane x'z' that is larger than the shear compliance of the first conveyor belt in the first conveying plane xz.

The first conveying section can be used for conveying the sheets through a processing stage where a particularly high positional accuracy is required, e.g. a printing station. Then, when the leading edge of a sheet reaches the second conveyor belt while the trailing part of the sheet is still held on the first conveyor belt, the very low shear compliance of the first conveyor belt will force the sheet to continue to move exactly in the first conveying direction. However, the higher shear compliance of the second conveyor belt permits this conveyor belt to follow the movement of the sheet, so that there will be no slip between the sheet and the conveyor belt, but the second conveyor belt will be slightly deflected in a lateral direction. As the sheet moves on, the grip of the first conveyor belt onto the sheet will decrease until the sheet is finally released by the first conveyor belt. At that instant, the second conveyor belt will return into its original posture so that the lateral deflection of the belt is reversed. As the sheet is held without slip on the second conveyor belt, the sheet will follow this lateral movement of the belt and will therefore be returned into a correct position on the second conveyor belt. In this way, the sheets can be passed-on from the first conveyor section to the second without any risk of ripping or wrinkling the sheet and also with a minimum of slip of the sheet relative to the conveyor belts.

Useful optional features of the invention are indicated in the dependent claims.

Preferably, in order to maintain a maximum of positional accuracy, the second conveyor belt may have, in spite of its shear compliance, an elastic expansion modulus comparable to that of the first conveyor belt. This may be achieved for example by using a woven fabric, preferably a plain weave fabric, for the second conveyor belt, with the warp threads, for example, extending in the conveying direction x', so that the tensile strength of the yarn will determine the tensile strength (elastic expansion modulus) of the conveyor belt, whereas the movability of the weft threads in lateral direction assures the high shear compliance. The fabric also has the advantage that it is porous and thereby assures the function of the suction box. Of course, it is preferable to use yarns that have a high tensile strength, e.g. yarns including carbon fibres or the like.

When the second conveying section includes a drum-type conveyor which may at the same time serve for cooling the sheets, for example, it is convenient to use the shear compliant second conveyor belt as an interface between the stiff first conveyor belt of the first conveying section and the stiff drum of the second conveying section, so that any possible alignment errors between the first and second conveying sections may still be compensated. In that case, the shear compliance of a second conveyor belt may also help to compensate any possible misalignment between the second conveyor belt and the drum conveyor.

In order to avoid any damage to the sheets, it will also be necessary to appropriately adjust the conveying speeds in the first and second conveying sections. In this respect, it is preferred that the first and second conveying planes xz and x'z' form an angle with one another, such that the sheet may be lifted off from the line of intersection between the two planes when the sheet is under tensional stress in the conveying direction. Then, in consideration of inevitable tolerances in the conveying speeds, the target speeds may be set such that the conveying speed in the second conveying section can be relied upon to be slightly higher but in no case lower than the conveying speed in the first conveying section. Consequently, when the leading edge of the sheet passes from the first conveyor belt onto the second conveyor belt, it will be slightly accelerated while the trailing part is still held back on the first conveyor belt, and the tensile strain that is created in the sheet will be compensated by the sheet being slightly lifted off from the line of intersection between the two conveying planes. In this way, the sheet can be safely passed on to the second conveyor belt without any risk of the sheet being ripped and without causing slip of the sheet relative to any of the two conveyor belts.

An embodiment example will now be described in conjunction with the drawings, wherein.

Figure 1:
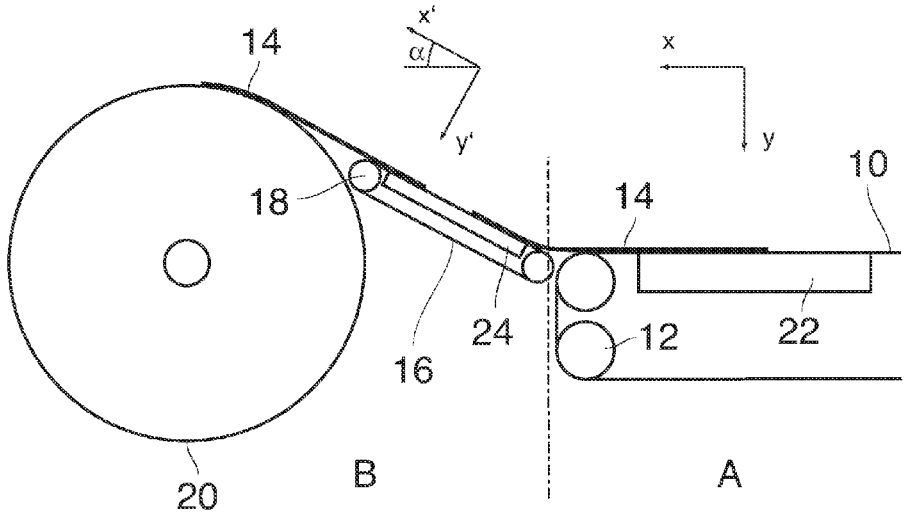
FIG. 1 is a schematic side view of a sheet conveying system.

As is shown in FIG. 1, a sheet conveying system, e.g. in a printer, comprises a first conveying section A having an endless first conveyor belt 10 passed over deflection rollers 12 and moved so as to convey sheets 14 in a first conveying direction x towards a second conveying section B.

The second conveying section B comprises an endless second conveyor belt 16 passed around deflection rollers 18 and adjoining the downstream end of the first conveyor belt 10 and driven to move the sheets 14 in a second conveying direction x'.

In the example shown, the second conveyor belt 16 is inclined such that it rises upwardly from the horizontal conveying plane of the first conveyor belt 10. Consequently, the first and second conveying directions x and x' form an angle $\alpha$.

The second conveying section B further includes a drum-type conveyor having a large diameter metal drum 20. The drum 20 has a perforated peripheral wall and includes a suction system for drawing-in ambient air through the perforations of the peripheral wall. As a consequence, the sheets 14 that have been passed on from the second conveyor belt 16 to the periphery of the drum 14 will be attracted and will be moved-on as the drum rotates. While the sheets 14, which have been heated in a previous processing step, are held in intimate contact with the drum surface, heat will be transferred onto the metal drum, so that the sheets are cooled. At a suitable angular position, the sheets 14 are released again from the drum 20 and passed-on to another conveyor which has not been shown here.

The first and second conveyor belts 10, 16 are also perforated, and suction boxes 22, 24 are disposed directly underneath the upper section of each of these conveyor belts, so that the sheets 14, as long as they rest on the conveyor belt, will be attracted to the belt due to vacuum action and will thereby be prevented from slipping relative to the belt.

In the first conveying section A, a high positional accuracy of the sheets 14 on the conveyor belt 10 is important. By way of example, it may be assumed that the first conveying section A serves for conveying the sheets 14 through a printing station of the printer, so that positional accuracy is important for obtaining a high print quality.

For this reason, the first conveyor belt 10 is formed by a thin perforated flexible metal film which has a high expansion-elastic modulus (i.e. a high tensile strength) and also a high shear modulus (e.g. more than 70 GPa), so that the exact alignment of the sheets 14 relative to the print heads (not shown) will not be compromised by elastic expansion or shear deformation of the conveyor belt 10.

In contrast, the second conveyor belt 12 is formed by a woven fabric which has also a high tensile strength, comparable to that of the first conveyor belt 10, but a much lower shear modulus. Preferably, the shear modulus of the second conveyor belt 16 is less than 10%, even more preferably less than 1% of the shear modulus of the first conveyor belt 10.

The reason for the low shear modulus of the second conveyor belt 16 will be explained below in conjunction with FIGS. 2 to 5.

Figure 2:
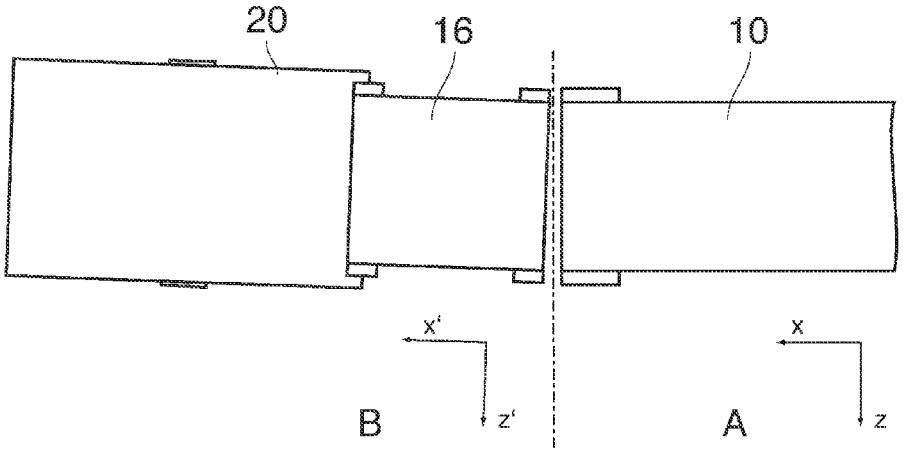
FIG. 2 is a schematic top plan view of the conveying system shown in FIG. 1.

As is shown in FIG. 2, the first conveyor belt 10 (the upper section thereof) extends and moves in the first conveying direction x and is extended in a lateral direction z normal to the first conveying direction x. The directions x and z define a first conveying plane xz. Similarly, the second conveyor belt 16 (the upper section thereof) extends and moves in the second conveying direction x' and also extends in a second lateral direction z' normal to the second conveying direction x'. The directions x' and z' define a second conveying plane x'z'.

Ideally, the first and second conveyor belts 10 and 16 and their respective conveying directions x and x' should be perfectly aligned in the horizontal plane, i.e. the projection of the second conveying direction x' onto the first conveying plane xz should be exactly parallel with the first conveying direction x. In practice, however, inevitable manufacturing and mounting tolerances will lead to a certain misalignment, so that, in the top plan view in FIG. 2, there will be a certain misalignment angle between the conveying directions x and x', although this angle has been exaggerated in FIG. 2 for illustration purposes.

Figure 3:
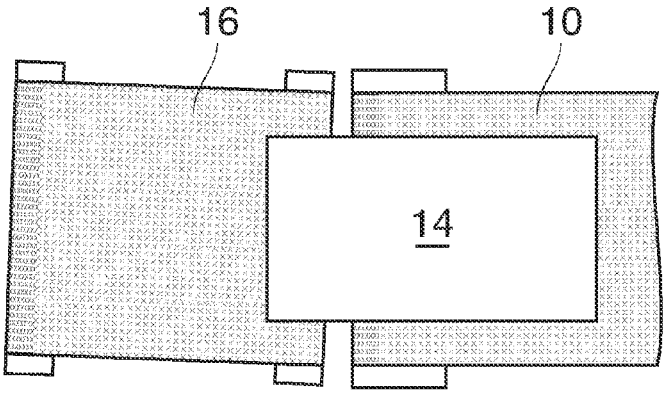
FIGS. 3 to 5 are schematic top plan views illustrating the function principle of the invention.

In FIG. 3, a sheet 14 is being supplied on the first conveyor belt 10, and its leading edge has just reached the second conveyor belt 16, while the major part of the sheet 14 is still firmly held on the perforated first conveyor belt 10 by vacuum action of the suction box 22.

Figure 4:
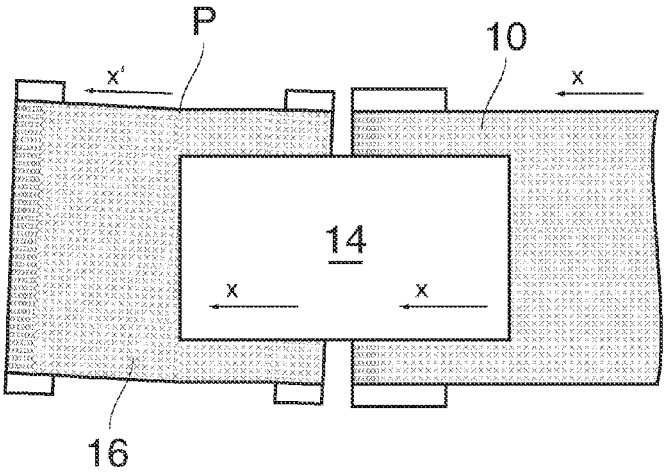
Figure 5:
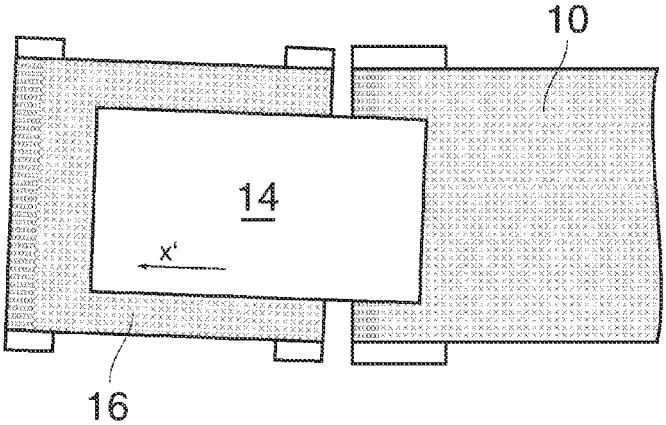

In FIG. 4, the sheet 14 has moved a bit further, and now its leading part is firmly held in position on the second conveyor belt 16 due to the vacuum action of the conveyor box 24. The trailing part of the sheet is still firmly held on the first conveyor belt 10. Due to the misalignment of the two conveyor belts, the leading part of the sheet 14 tends to move in a different direction than the trailing part. As a consequence, as the sheet 14 is stiff in its own plane and can slip neither relative to the first conveyor belt 10 nor relative to the second conveyor belt 16, the forces acting upon the leading and trailing parts of the sheets would tend to rip or warp the sheet.

However, as is shown in FIG. 4, the shear compliance of the second conveyor belt 16 has the effect that it is the second conveyor belt that yields. Thus, while the orientation and direction of movement of the sheet 14 is still determined by the stiff first conveyor belt 10, the part of the second conveyor belt 16 that is covered by the leading part of the sheet 14 is firmly attached to that sheet and is therefore deflected sideways relative to the second conveying direction x'. In other words it is forced to move in the first conveying direction x. Consequently, the upper section of the second conveyor belt 16 is angled at a point P at the level of the leading edge of the sheet 14. Thus, the sheet 14 will neither slip nor will it be ripped or warped.

As the sheet 14 moves on, the trailing part of the sheet that is still firmly held on the first conveyor belt 10 will gradually shrink to zero, and at a certain point the forces exerted by the first conveyor belt 10 will no longer be sufficient to hold the sheet 14 in position against the restoring forces of the second conveyor belt 16. At that point, the second conveyor belt 16 will return to its normal posture, as has been shown in FIG. 5, and the sheet 14 will participate in that movement, so that the sheet does not slip relative to the second conveyor belt 16. Only the very small trailing part of the sheet that still overlaps with the first conveyor belt 10 will undergo a minor slip (rotation) relative to that first conveyor belt.

Figure 6:
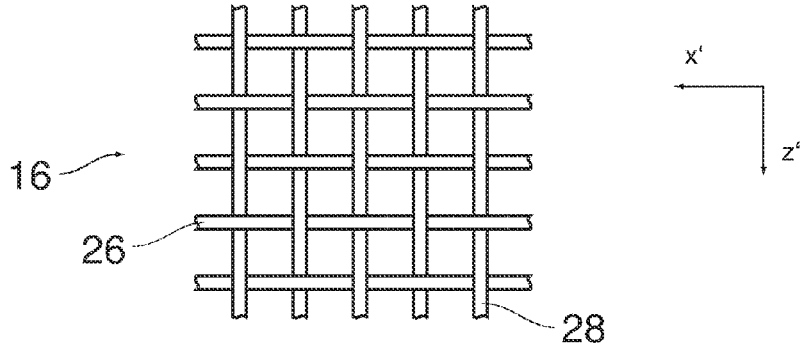
FIGS. 6 and 7 are enlarged views of a fabric forming a shear compliant conveyor belt.
Figure 7:
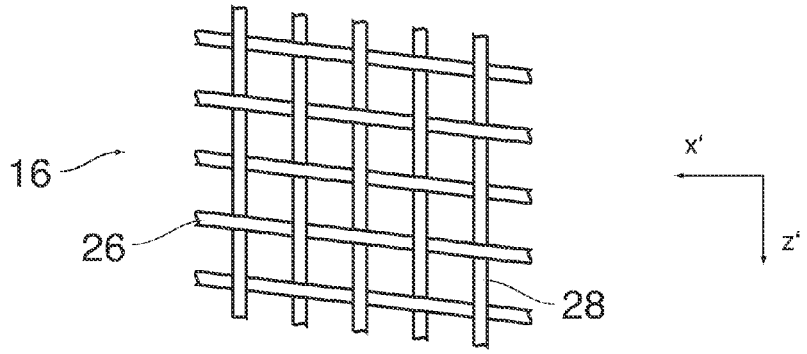

FIG. 6 is an enlarged view of a part of the second conveyor belt 16 that is made of a plain weave fabric having warp threads 26 extending in the second conveying direction x' and weft threads 28 extending in the second lateral direction z', normally at right angles to the warp threads 26. Thus, the tensile strength of the warp threads 26 assures the tensile strength of the conveyor belt 16. However, as the angle between the warp threads 26 and the weft threads 28 is not fixed, the fabric is compliant under shear stress, as has been illustrated in FIG. 7.

Figure 8:
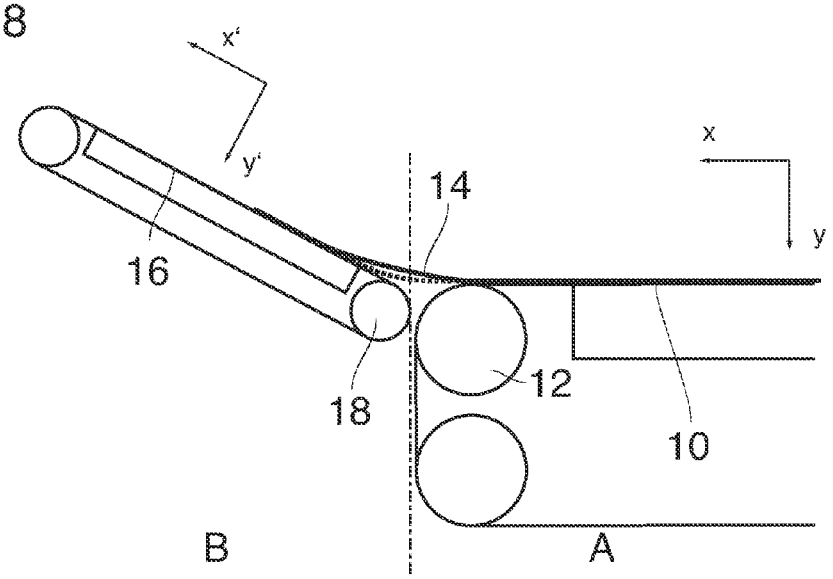
FIG. 8 is an enlarged side view of a transition area between first and second conveyor belts.

FIG. 8 is an enlarged side view of the transition zone between the first conveying section A and the second conveying section B.

The inclination of the second conveyor belt 16 relative to the first conveying plane xz of the first conveyor belt 10 has the effect that the sheet 14 forms a narrow bend at the transition point, as has been indicated by a dotted line in FIG. 8. Ideally, the sheet would form a sharp kink at the line where the first conveying plane xz intersects the second conveying plane x'z'. However, when the conveying speed of the second conveyor belt 16 is slightly larger than that of the first conveyor belt 10, the sheet 14 will be stretched and caused to lift off from the line of intersection at the bend, as has been shown by a continuous line in FIG. 8. In this way, a speed difference between the first and second conveyor belts can be compensated without any risk of damage to the sheet 14. As the sheet moves on, it will be progressively lifted off from the intersection line at the transition point, until the trailing edge of the sheet leaves the first conveyor belt 10.

Conversely, when the speed of the second conveyor belt 16 would be slightly smaller than that of the first conveyor belt 10, the sheet 14 would be caused to buckle downward into a gap between the deflection rollers 12 and 18. Although such buckling may be tolerated to a certain extent, it will be preferable to adjust the target speeds of the conveyor belts 10 and 16 such that, given the speed tolerances, the speed of the second conveyor belt 16 will be rather higher than lower than the speed of the first conveyor belt 10.

It will be observed that the bend in the sheet 14 at the transition point will increase the stiffness of the sheet in the lateral direction z or z'. However, due to the shear compliance of the second conveyor belt 16, this has no adverse effect on the conveying properties.

The invention claimed is:

1. A sheet conveying system comprising an upstream conveyor section having an endless first conveyor belt movable in a first conveying direction and extending in a first lateral direction, said first conveying direction and said first lateral direction defining a first conveying plane; and a downstream conveyor section having an endless second conveyor belt that adjoins the first conveyor belt and is movable in a second conveying direction and extends in a second lateral direction, said second conveying direction and said second lateral direction defining a second conveying plane, the conveyor sections being adapted to hold the sheets slip-free on the first and second conveyor belts, wherein the second conveyor belt has a shear compliance in the second conveying plane that is larger than the shear compliance of the first conveyor belt in the first conveying plane.

2. The system according to claim 1, wherein the second conveyor belt is made of a woven fabric.

3. The system according to claim 2, wherein the second conveyor belt is made of a plain weave fabric with either warp threads or weft threads extending in the second conveying direction.

4. The system according to claim 1, wherein the first conveyor belt is made of a metal film.

5. The system according to claim 1, wherein the second conveyor section includes a drum-type conveyor downstream of the second conveyor belt.

6. The system according to claim 1, wherein the first conveying plane and the second conveying plane form an angle with one another.

* * * * *